US011346033B2

(12) United States Patent
Kim et al.

(10) Patent No.: US 11,346,033 B2
(45) Date of Patent: May 31, 2022

(54) CLOTHES TREATMENT APPARATUS

(71) Applicant: LG ELECTRONICS INC., Seoul (KR)

(72) Inventors: Doohyun Kim, Seoul (KR); Jeongkon Kim, Seoul (KR); Youngjae Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 568 days.

(21) Appl. No.: 16/326,004

(22) PCT Filed: Aug. 16, 2017

(86) PCT No.: PCT/KR2017/008874
§ 371 (c)(1),
(2) Date: Feb. 15, 2019

(87) PCT Pub. No.: WO2018/034482
PCT Pub. Date: Feb. 22, 2018

(65) Prior Publication Data

US 2021/0324569 A1 Oct. 21, 2021

(30) Foreign Application Priority Data

Aug. 16, 2016 (KR) ..... 10-2016-0103681

(51) Int. Cl.
*D06F 25/00* (2006.01)
*D06F 58/24* (2006.01)
(Continued)

(52) U.S. Cl.
CPC ..... *D06F 25/00* (2013.01); *D06F 58/24* (2013.01); *D06F 39/088* (2013.01); *D06F 58/206* (2013.01)

(58) Field of Classification Search
CPC ..... D06F 58/206; D06F 58/24; D06F 58/00
(Continued)

(56) References Cited

U.S. PATENT DOCUMENTS 2,742,708 A * 4/1956 McCormick ..... D06F 58/24 34/76
4,154,003 A * 5/1979 Muller ..... D06F 25/00 34/469
(Continued)

FOREIGN PATENT DOCUMENTS

EP 2889427 7/2015
EP 3779023 A1 * 2/2021 ..... D06F 58/10
(Continued)

OTHER PUBLICATIONS

European Search Report dated Feb. 26, 2020 based on European Patent Application 17841664.0.
(Continued)

*Primary Examiner* — Stephen M Gravini
(74) *Attorney, Agent, or Firm* — Birch, Stewart, Kolasch & Birch, LLP

(57) ABSTRACT

A clothes treatment apparatus includes a cooling water pipe that is placed within a condensing duct to condense humidity contained in a circulating air current. The latent heat generated from the condensation of humidity causes the temperature of the cooling water in the cooling water pipe to rise. A thermoelectric pump mechanism collects heat from the higher-temperature cooling water and uses it in heating the circulating air.

20 Claims, 7 Drawing Sheets

(51) Int. Cl.
*D06F 39/08* (2006.01)
*D06F 58/20* (2006.01)

(58) Field of Classification Search
USPC ..... 34/86, 595–610
See application file for complete search history.

(56) References Cited

U.S. PATENT DOCUMENTS

| | | | | |
|---|---|---|---|---|
| 7,526,879 | B2 * | 5/2009 | Bae | D06F 58/206 34/596 |
| 8,209,881 | B2 * | 7/2012 | Lee | D06F 58/24 34/595 |
| 10,240,276 | B2 * | 3/2019 | Ryoo | D06F 58/206 |
| 10,590,588 | B2 * | 3/2020 | Kim | D06F 39/04 |
| 10,704,189 | B2 * | 7/2020 | Christensen | D06F 58/04 |
| 10,907,297 | B2 * | 2/2021 | Kohavi | F24F 3/1405 |
| 11,029,088 | B2 * | 6/2021 | Herman | D06F 58/38 |
| 11,078,619 | B2 * | 8/2021 | Herman | F26B 3/347 |
| 2006/0225468 | A1 * | 10/2006 | Hong | D06F 25/00 68/20 |
| 2007/0101602 | A1 | 5/2007 | Bae et al. | |
| 2008/0006308 | A1 | 1/2008 | Classen et al. | |
| 2009/0320311 | A1 | 12/2009 | Lee | |
| 2016/0160419 | A1 * | 6/2016 | Ryoo | D06F 58/20 68/12.14 |
| 2021/0140095 | A1 * | 5/2021 | Kim | D06F 71/36 |
| 2021/0156072 | A1 * | 5/2021 | Won | D06F 58/24 |

FOREIGN PATENT DOCUMENTS

| | | |
|---|---|---|
| JP | 2005-224490 | 8/2005 |
| JP | 2012-231829 | 11/2012 |
| KR | 10-2007-0045020 | 5/2007 |
| KR | 10-2008-0075150 | 8/2008 |
| KR | 10-2014-0050982 | 4/2014 |

OTHER PUBLICATIONS

PCT International Search Report dated Dec. 19, 2017 based on PCT/KR2017/008874.

* cited by examiner

CLOTHES TREATMENT APPARATUS

CROSS-REFERENCE TO RELATED APPLICATIONS

This application is a U.S. National Phase entry under 35 U.S.C. § 371 from PCT International Application No. PCT/KR2017/008874, filed Aug. 16, 2017, which claims the benefit of priority of Korean Patent Application No. 10-2016-0103681 filed Aug. 16, 2016, the contents of which are incorporated herein by reference in their entireties.

DESCRIPTION OF THE INVENTION

Field of the Invention

The present invention relates to a clothes treatment apparatus with a drying function.

BACKGROUND OF THE INVENTION

Generally, a clothes treatment apparatus collectively refers to an apparatus that treats clothes by applying physical and chemical actions to the clothes. Examples of such a clothes treatment apparatus may include a washer, which removes contaminants adhered to clothes, a dewaterer, which dewaters clothes by rotating a basket (or drum) containing clothes at a high speed, and a dryer, which dries wet clothes by supplying cold air or hot air into the basket containing clothes. A washer with both a washing function and a drying function may be categorized as a clothes treatment apparatus.

In particular, a clothes treatment apparatus with a drying function usually heats air using an electric heater, and forcibly blows the heated air into a chamber into which clothes are poured. A clothes treatment apparatus equipped with a condensation drying system comes with a condenser for removing humidity from air that becomes humid as it passes through the chamber. Thus, the air passed through the condenser is heated by the heater, and then supplied back into the chamber.

The recent clothes treatment apparatuses include ones using the Peltier effect, which employ a thermoelectric heat pump whose heat absorbing surface absorbs ambient heat and whose heat generating surface releases heat. In this case, the heat absorbing surface of the thermoelectric heat pump serves as a condenser, and the heat generating surface thereof serves as a heater.

In a typical dryer with a water-cooled condenser which eliminates humidity from the circulating air by using cooling water, the latent heat generated from the condensation of humid air causes the temperature of the cooling water to rise. Once the temperature rises, it is necessary to drain the cooling water and provide a constant supply of cooling water. However, this is not beneficial in terms of condensation efficiency or condensation rate and not advantageous in terms of energy efficiency.

DISCLOSURE OF THE INVENTION

Technical Problem

The present disclosure is directed to providing a clothes treatment apparatus that has a thermoelectric module for heating a circulating air current and a cooling water pipe for condensing humidity from the circulating air current.

Particularly, there is provided a clothes treatment apparatus that improves the efficiency of the thermoelectric module by collecting heat from the cooling water in the cooling water pipe, when the temperature of the cooling water rises due to the latent heat generated from the condensation of humidity in the circulating air current.

In addition, there is provided a clothes treatment apparatus that improves energy efficiency by using the latent heat generated from the condensation of humid air.

Technical Solution

A clothes treatment apparatus according to the present invention comes with a cooling water pipe that is placed within a condensing duct to condense humidity contained in a circulating air current. The latent heat generated from the condensation of humidity causes the temperature of the cooling water in the cooling water pipe to rise. A thermoelectric pump mechanism collects heat from the higher-temperature cooling water and uses it in heating the circulating air.

The cooling water, which undergoes a temperature fall after giving up its heat to the thermoelectric pump mechanism, is re-supplied into the condensing duct and re-used in condensing humidity.

A clothes treatment apparatus according to one aspect of the present invention includes: a chamber forming a space for treating clothes; a circulatory flow path for guiding air for circulation through the chamber; a drying fan placed on the circulatory flow path to blow air for circulation; a cooling water pipe forming a pipeline for cooling water to flow in the circulatory flow path; a water jacket placed on the outer side of the circulatory flow path and connected to an outlet of the cooling water pipe, into which, after exchanging heat with the air in the circulatory flow path, the cooling water is introduced; and a thermoelectric pump mechanism for absorbing heat from the cooling water in the water jacket and transferring the heat to the air downstream of the cooling water pipe.

A clothes treatment apparatus according to another aspect of the present invention includes: a chamber forming a space for treating clothes; a circulatory flow path for guiding air for circulation through the chamber; a drying fan placed on the circulatory flow path to blow air for circulation; a cooling water pipe forming a pipeline for cooling water to flow in the circulatory flow path; a water jacket placed on the outer side of the circulatory flow path and connected to an outlet of the cooling water pipe, into which, after exchanging heat with the air in the circulatory flow path, the cooling water is introduced; a thermoelectric module for transferring heat from a heat absorbing surface to a heat generating surface; and a heat sink for taking heat from the heat generating surface and heating the air that has exchanged heat with the cooling water pipe on the circulatory flow path, wherein the heat absorbing surface exchanges heat with the water jacket.

Advantageous Effects

The clothes treatment apparatus of the present invention has the advantage of increasing the efficiency of a thermoelectric pump mechanism by transferring heat collected from cooling water in a water jacket to a heat generating part of the thermoelectric pump mechanism.

Furthermore, the cooling water in the water jacket gives up its heat to the thermoelectric pump mechanism, and undergoes a temperature fall. Once the temperature falls, the cooling water is supplied again into a condensing duct and comes into contact with humid air, thereby increasing condensation efficiency and improving condensation rate.

DESCRIPTION OF THE EMBODIMENTS

Mode for Invention

Figure 1:
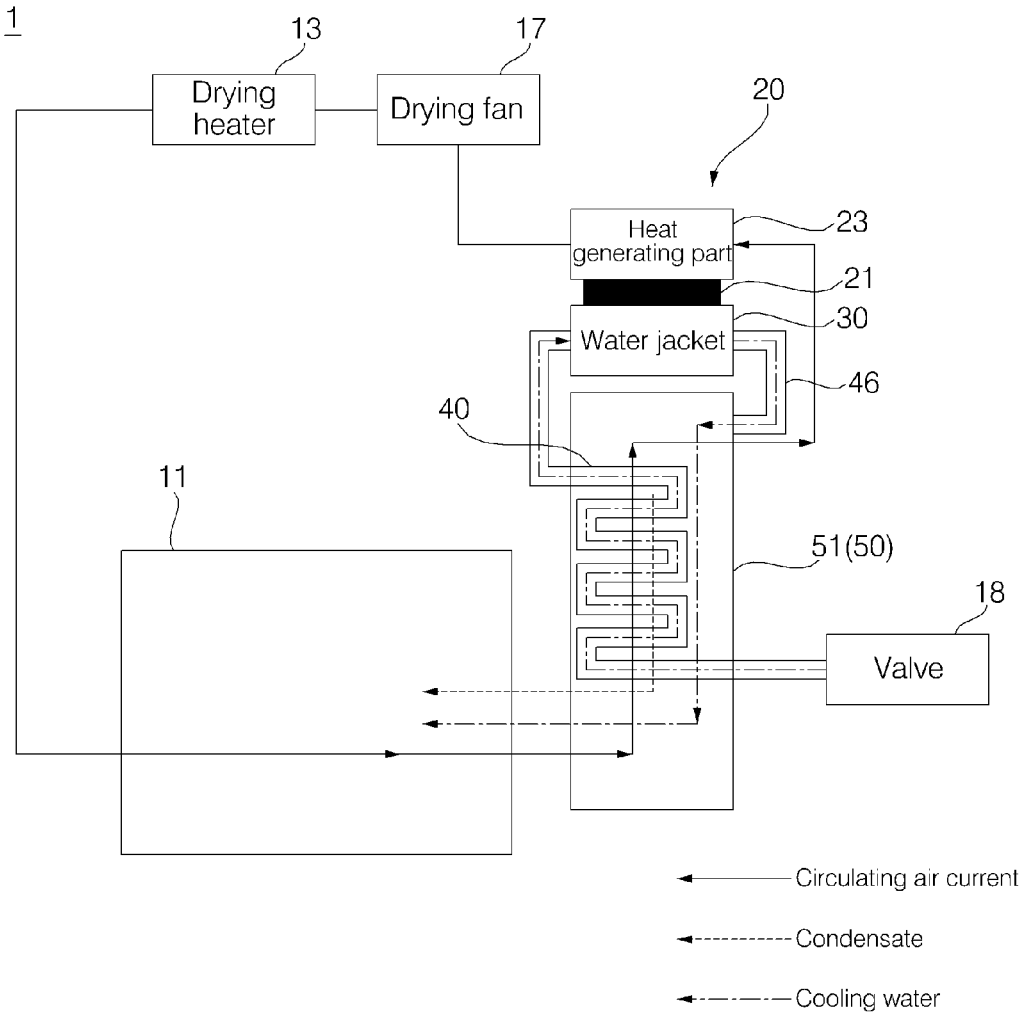
FIG. 1 is a schematic diagram illustrating an example of a clothes treatment apparatus according to an exemplary embodiment of the present invention.

Advantages and features of the present invention and methods for achieving them will be made clear from embodiments described below in detail with reference to the accompanying drawings. The present invention may, however, be embodied in many different forms and should not be construed as being limited to the embodiments set forth herein. Rather, these embodiments are provided so that this disclosure will be thorough and complete, and will fully convey the scope of the invention to those skilled in the art. The present invention is merely defined by the scope of the claims. Like reference numerals refer to like elements throughout the specification.

Figure 2:
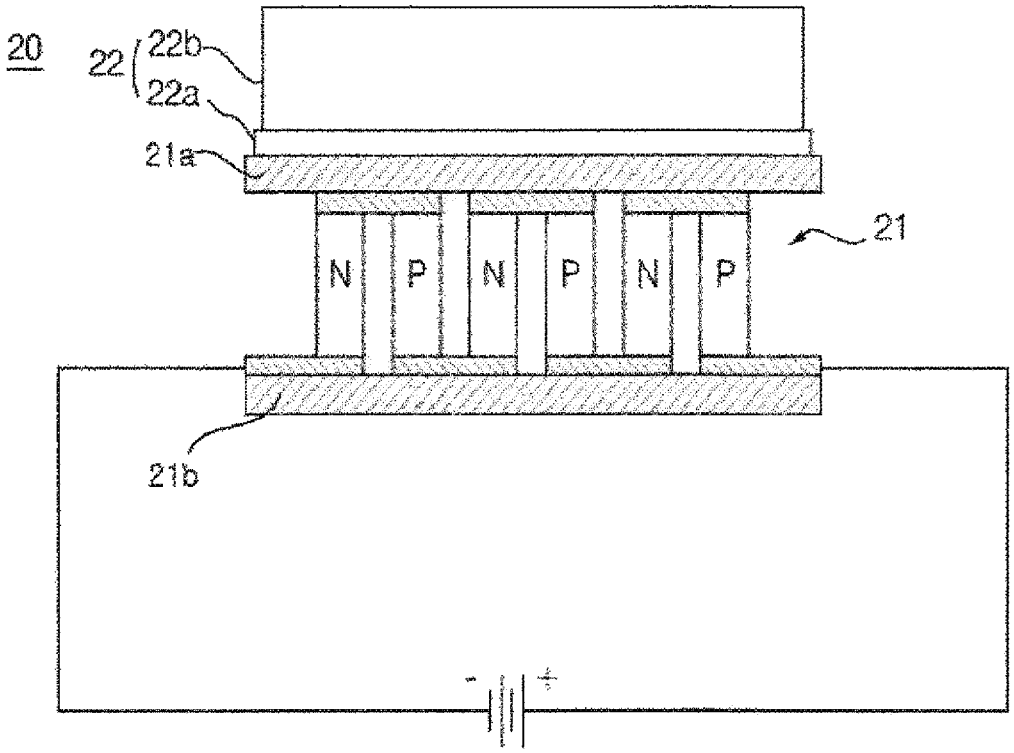
FIG. 2 illustrates a thermoelectric pump unit.

FIG. 1 is a schematic diagram illustrating an example of a clothes treatment apparatus according to an exemplary embodiment of the present invention. FIG. 2 illustrates a thermoelectric pump unit.

In general, examples of the clothes treatment apparatus may include a wash-only washer which typically performs washing, a dry-only dryer, and a combination washer-dryer.

The clothes treatment apparatus 1 includes a chamber 11 forming a space for treating clothes, a circulatory flow path 50 (a path in FIG. 1 through which a circulating air current flows) for guiding air for circulation through the chamber 11, and a drying fan 17 placed on the circulatory flow path 50 and for blowing air.

The blown air (circulating air current) is supplied into the chamber 11 by the drying fan 17. As the humidity removed from clothes re-enters the circulatory flow path 50, the air current passing through the chamber 11 is circulated.

A drying heater 13 for heating air may be provided on the circulatory flow path 50. The drying heater 13 may be composed of an electric heater—for example, a coil heater, a sheath heater, etc. Preferably, the drying heater 13 is located downstream of the drying fan 17. The air blown by the drying fan 17 is heated as it passes through the drying heater 13, and the heated air is supplied into the chamber 11, thus drying clothes. Of course, only the drying fan 17 may operate, but not the drying heater 13, to supply unheated air into the chamber 11.

A condensing duct 51 constitutes the circulatory flow path 50. An inlet of the condensing duct 51 connects to the chamber 11. The air released from the chamber 11 is introduced into the condensing duct 51 via the inlet. As the air (circulating air current) within the condensing duct 51 comes into the cooling water pipe 40, humidity contained in the air condenses. The condensate produced at this time may naturally drip down within the condensing duct 51 and then be drained into the chamber 11 via the inlet of the condensing duct 51.

In the case of a combination washer-dryer, the chamber 11 may include a tub (not shown) for containing washwater and a drum (not shown) that rotates within the tub, and the condensing duct 51 connects to the tub. The condensate produced within the condensing duct 51 collects at the bottom of the tub, and therefore the clothes in the drum is not soaked in the condensate.

In the case of a dry-only clothes treatment apparatus (or dryer), which has no tube for containing washwater, a flow path may be provided to drain the condensate in the condensing duct 51 out of the clothes treatment apparatus.

The cooling water pipe 40 forms a pipeline through which cooling water flows. Water supplied from an external water source (for example, a faucet) may be introduced into the cooling water pipe 40. A valve 18 for controlling the supply of water to the cooling water pipe 40 may be provided. During a drying cycle, the valve 18 may be opened to supply cooling water to the cooling water pipe 40.

At least part of the cooling water pipe 40 may be placed within the condensing duct 51. The air flowing along the condensing duct 51 comes into contact with the outside surface of the cooling water pipe 40, in the course of which humidity contained in the air condenses.

A water jacket 30 is placed on the outer side of the circulatory flow path 50 and connected to an outlet 40*b* (see FIGS. 6 and 7) of the cooling water pipe 40. The water jacket 30 may be placed on the outside surface of the condensing duct 51. After exchanging heat with the air in the condensing duct 51, the cooling water is introduced into the water jacket 30. The cooling water in the cooling water pipe 40 absorbs the latent heat generated from the condensation of humidity in the condensing duct 51. Therefore, the cooling water introduced into the water jacket 30 has a higher temperature compared to when first supplied to the cooling water pipe 40.

The thermoelectric pump mechanism 20 is a solid-state active heat pump which transfers heat from a heat absorbing surface to a heat generating surface by using the Peltier effect. The thermoelectric pump mechanism 20 absorbs heat from the water jacket 30, and transfers the absorbed heat to a heat generating part 23. The heat generating part 23 heats the air that has exchanged heat with the cooling water pipe 40 (that is, the air flowing downstream of the cooling water pipe 40). The heat generating part 23 may include a heat sink 22 that takes heat from a heat generating surface of a thermoelectric module 21 to be described later.

Referring to FIG. 2, the thermoelectric pump mechanism 20 may include a thermoelectric module 21 for transferring heat from a heat absorbing surface to a heat generating surface and a heat sink 22 for taking heat from the heat generating surface and heating the air that has exchanged heat with the cooling water pipe 40 on the circulatory flow path 50.

A P-type semiconductor (P) and an N-type semiconductor (N) are mounted between a heat absorbing plate 21*b* and heat generating plate 21*a* of the thermoelectric module 21. By connecting a direct-current positive electrode (+) to the P-type semiconductor (P) and a direct-current negative electrode (−) to the N-type semiconductor (N), heat is transferred from the heat absorbing plate 21*b* to the heat generating plate 21*a* by the Peltier effect. The heat absorbing plate 21*b* and heat generating plate 21*a* may be preferably made of ceramic material.

At least part of the heat sink 22 comes into contact with the air in the condensing duct 51. The heat sink 22 may include a base 22*a* and at least one heat radiating fin 22*b* that protrudes from the base 22*a* and is inserted into the condensing duct 51.

One side of the base 22*a* comes into contact with the heat generating surface of the thermoelectric module 21 (or one side of the heat generating plate 21*a*), and the other side thereof lies on the outside surface of the condensing duct. The heat radiating fin 22*b* may protrude from the other side of the base 22*a*. The heat radiating fin 22*b* is shaped like a plate that longitudinally extends along a direction in which the circulating air current flows, and a plurality of heat radiating fins 22*b* may be placed parallel to each other. The air current in the condensing duct 51 is heated as it passes between the heat radiating fins 22*b*, in the course of which the relative humidity of the circulating air current goes down.

The air heated by the heat sink 22 is blown again by the drying fan 17, in the course of which the air is re-heated by the drying heater 13 and then supplied into the chamber 11.

Figure 3:
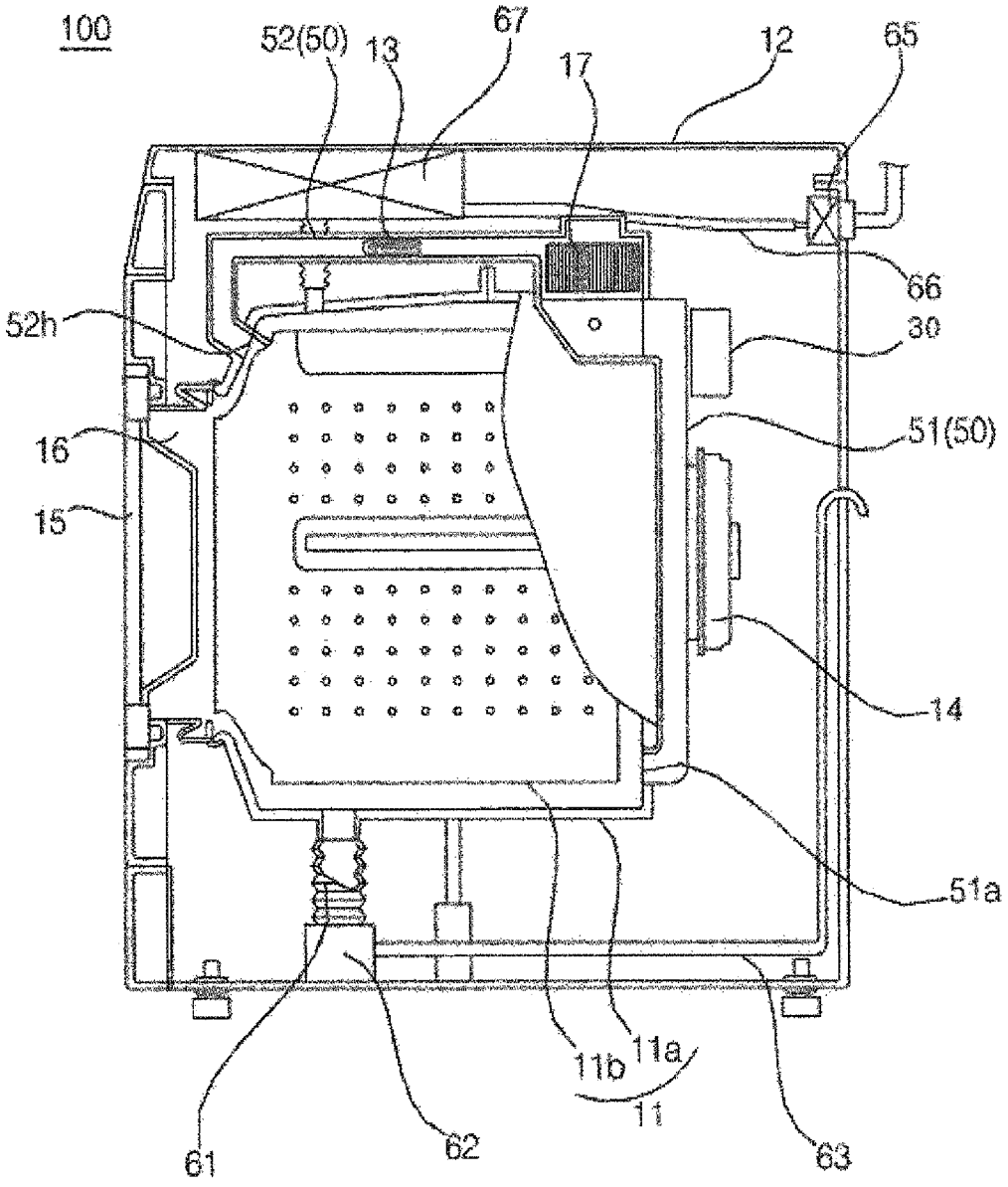
FIG. 3 is a side cross-sectional view illustrating a clothes treatment apparatus according to another exemplary embodiment of the present invention.
Figure 4:
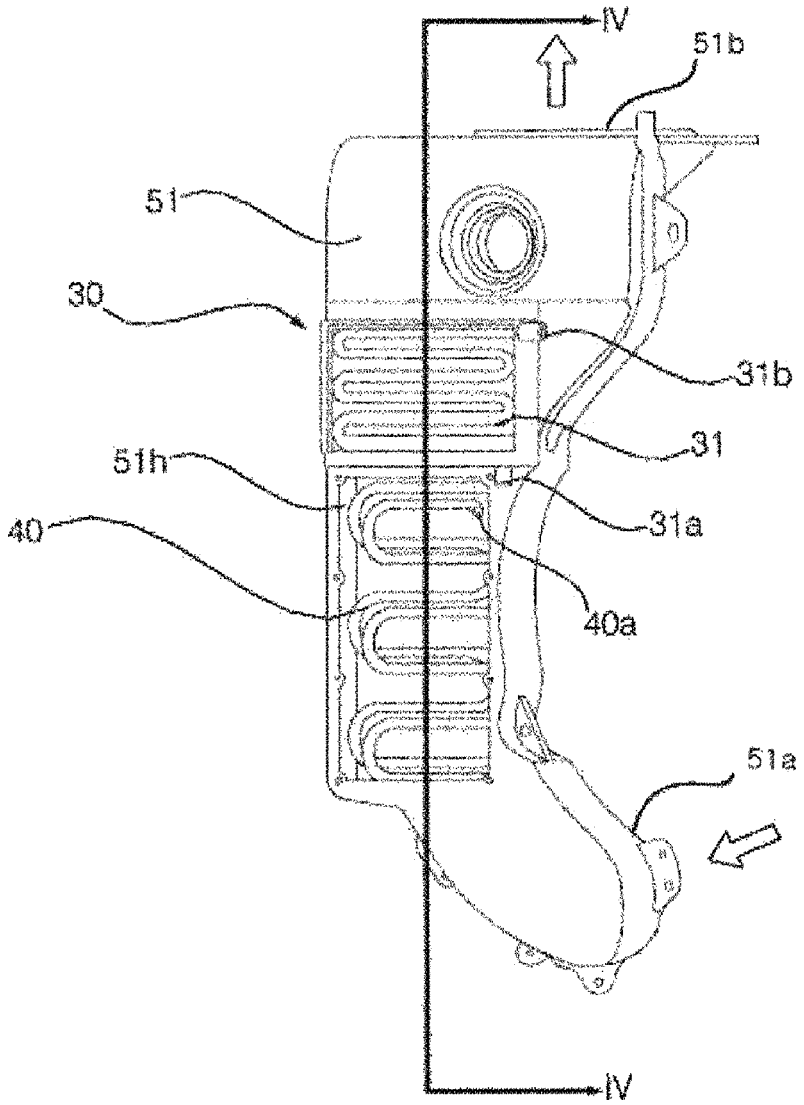
FIG. 4 is an assembly diagram of the condensing duct, water jacket, and cooling water pipe illustrated in FIG. 3.
Figure 5:
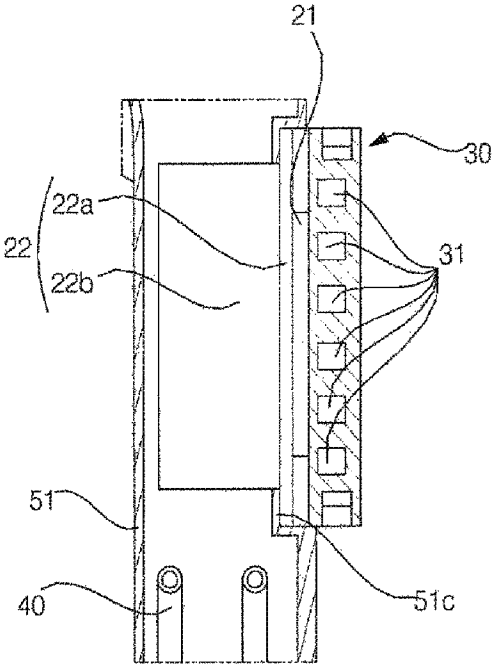
FIG. 5 shows a cross-sectional view (a) taken along the line IV-IV of FIG. 4 and an enlarged view (b) of the portion V.
Figure 5:
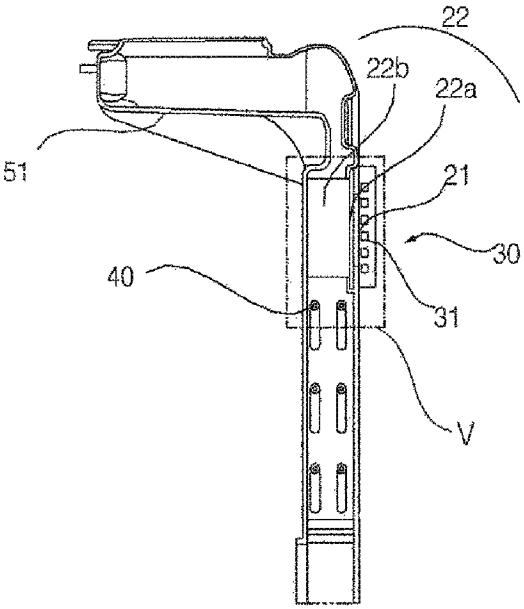
Figure 6:
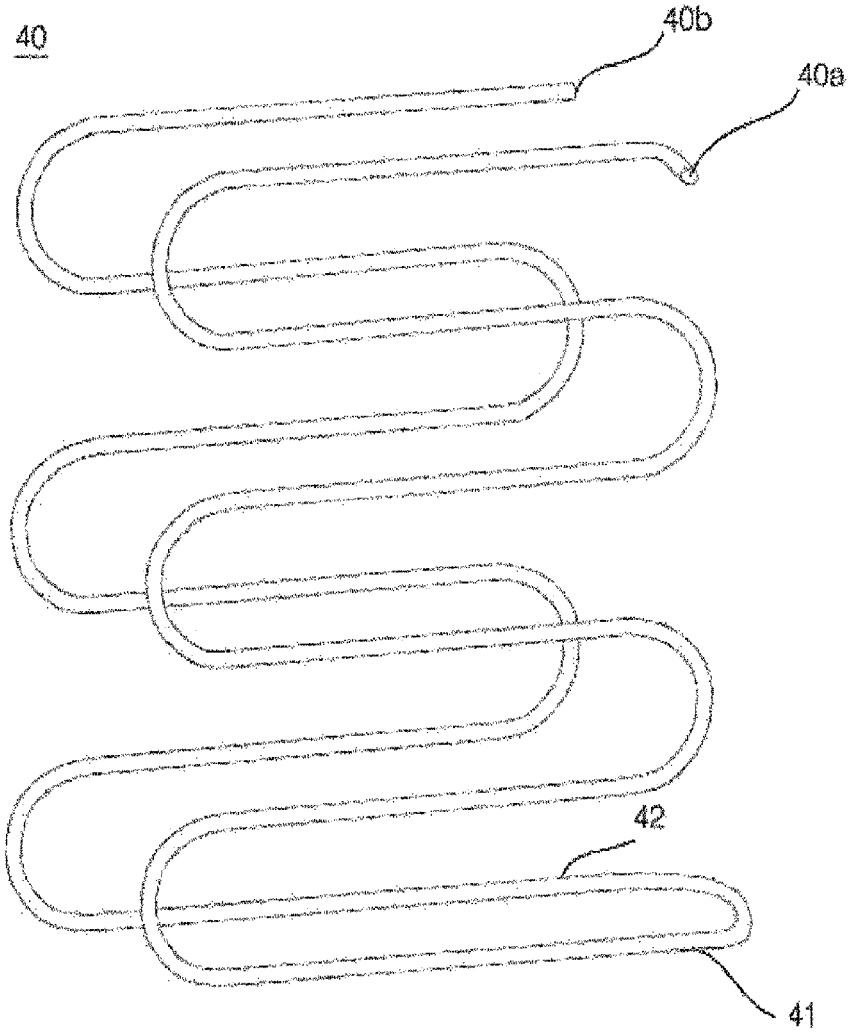
FIG. 6 is a perspective view of the cooling water pipe illustrated in FIG. 4.
Figure 7:
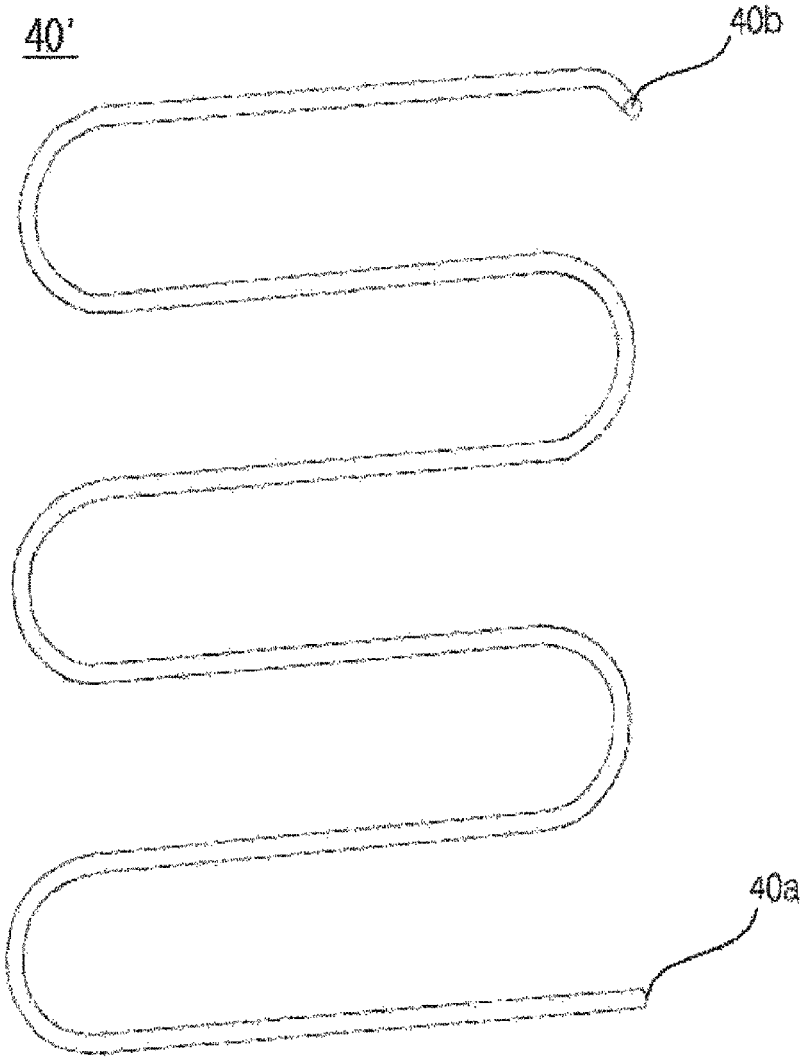
FIG. 7 shows another embodiment of the cooling water pipe.

FIG. 3 is a side cross-sectional view illustrating a clothes treatment apparatus according to another exemplary embodiment of the present invention. FIG. 4 is an assembly diagram of the condensing duct, water jacket, and cooling water pipe illustrated in FIG. 3. FIG. 5 shows a cross-sectional view (a) taken along the line IV-IV of FIG. 4 and an enlarged view (b) of the portion V. FIG. 6 is a perspective view of the cooling water pipe illustrated in FIG. 4. FIG. 7 is an another embodiment of the cooling water pipe.

Referring to FIGS. 3 to 6, the clothes treatment apparatus 100 includes a cabinet 12 forming the exterior, a tub 11*a* provided within the cabinet 12 and containing washwater, and a circulatory flow path 50 for guiding an air current circulated through the tub 11*a*. The tub 11*a* corresponds to the chamber 11 forming a space for treating clothes, and a drum 11*b* for containing clothes is provided within the tub 11*a* in such a way as to be rotatable by a motor 14.

On the front of the cabinet 12 is a slot through which clothes are loaded into the drum 11*b*, and a door 15 for opening and closing the slot may be rotatably attached to the cabinet 12. To prevent the water in the tub 11*a* from leaking through the slot, a gasket 16 may be provided between the cabinet 12 and the tub 11*a*.

A water supply valve 65 may be provided to control the water supply from an external water source, a water supply hose 66 may be provided to let the water supplied through the water supply valve 65 flow through it, and a dispenser 67 may be provided to contain detergent and supply the detergent into the tub 11*a* along with the water supplied from the water supply hose 66.

The circulatory flow path 50 may include a condensing duct 51 and a drying duct 52. An outlet 52*h* of the drying duct 52 may be connected to the front top of the tub 11*a*.

The condensing duct 51 may be placed behind the tub 11*a*. An inlet 51*a* of the condensing duct 51 may connect to the tub 11*a*, and an outlet 51*b* thereof may connect to the drying duct 52.

The cooling water pipe 40 may be placed within the condensing duct 51. The condensing duct 51 may have an opening 51*h* for installing the cooling water pipe 40. Although not shown, a cover for opening and closing the opening 51*h* also may be provided, and a sealer (not shown) may be interposed between the cover and the opening 51*h* to keep them airtight, in order to keep the air in the condensing duct 51 from leaking while the opening 51*h* is closed with the cover.

The water jacket 30 is placed on the outside surface of the condensing duct 51, and its inlet 31*a* is connected to the outlet 40*b* of the cooling water pipe 40. The water jacket 30 may have a cooling water flow path 31 that extends from the inlet 31*a* to the outlet 31*b*. The cooling water flow path 31 may be bent in such a way that the direction of cooling water flow is reversed multiple times.

A connecting pipe (not shown) may be provided to connect the outlet 40*b* (see FIG. 6) of the cooling water pipe 40 and the water jacket 30. Since the cooling water pipe 40 is placed within the condensing duct 51, the cover for covering the opening 51*h* is preferably formed with a through-hole which the connecting pipe passes through. A sealer may be interposed between the through-hole and the connecting pipe to keep them airtight.

A cooling water drain pipe 46 (see FIG. 1) may be provided to drain the cooling water in the water jacket 30 into the condensing duct 51. The cooling water drain pipe 46 may be connected to the outlet 31*b* of the water jacket 30.

Because the cooling water in the water jacket 30 gives up its heat to the heat absorbing surface (one surface of the heat absorbing plate 21*b*) of the thermoelectric module 21, low-temperature cooling water is drained through the cooling water drain pipe 46. The air in the condensing duct 51 comes into contact with the cooling water drained into the condensing duct 51 through the cooling water drain pipe 46, in the course of which humidity in the air condenses. That is, humidity contained in the air within the condensing duct 51 condenses on contact with the cooling water drained through the cooling water drain pipe 46, as well as on contact with the cooling water pipe 40.

The cooling water drained into the condensing duct 51 flows into the tub 11*a* via the inlet 40*a*. The water in the tub 11*a* is drained through a drain bellows 61, and may be drained through a drain hose 63 when a drain pump 62 is operated.

The cooling water drain pipe 46 may be configured to drain the cooling water towards the inner wall of the condensing duct 51. If the cooling water drips down the inner wall of the condensing duct 51, it may be contact with the air for a longer period of time, as compared to when it naturally drips down straight to the bottom of the condensing duct 51. The inside surface of the condensing duct 51 that comes in contact with the cooling water may be acute-angled to the horizon, which allows for a reduction in flow rate as compared to when the cooling water flows vertically.

The thermoelectric pump mechanism 20 may include a thermoelectric module 21 and a heat sink 22. These components are substantially the same as those described with reference to FIG. 1, detailed descriptions thereof will be omitted.

The thermoelectric pump mechanism 20 may be fixed to the condensing duct 51. A recess 51*c* may be formed on the outside surface of the condensing duct 51, and the base 22*a* of the heat sink 22 may be placed within the recess 51*c*. An opening may be formed through the bottom of the recess 51*c* to allow the heat radiating fins 22*b* of the heat sink 22 to pass therethrough. The gap between the opening and the radiating fins 22*b* may be sealed.

The drying duct 52 guides the air supplied from the condensing duct 51 to the tub 11*a*, and may be connected to the front of the tub 11*a*. The drying fan 17 and the drying heater 13 may be provided within the drying duct 52. Preferably, the drying heater 13 is located downstream of the drying fan 17.

Referring to FIG. 5, the cooling water pipe 40 may include a downward guiding part 41 for guiding the cooling water introduced via the inlet 40*a* downward and an upward guiding part 42 for guiding the cooling water supplied from the downward guiding part 41 upward to the outlet 40*b*. At least one between the downward guiding part 41 and the upward guiding part 42 may be bent in such a way that the direction of flow is reversed multiple times. Particularly, at least one between the downward guiding part 41 and the upward guiding part 42 may be bent multiple times such that the cooling water is repeatedly guided horizontally and then in the opposite direction. This increases the length of a flow path from the inlet 40*a* to the outlet 40*b* and therefore widens the heat-exchange area between the cooling water and the air and also enables heat exchange for a longer period of time.

Meanwhile, referring to FIG. 7, in the cooling water pipe 40', an inlet 40*a* through which the cooling water enters may be located lower than the outlet 40*b* through which the cooling water is drained. Even if the cooling water supply is stopped as the valve 18 is closed, the remaining cooling water may be contained in the cooling water pipe 40'. Accordingly, the condensation effect from the remaining cooling water may continue at least for a certain amount of time even if the valve 18 is closed.

What is claimed is:

1. A clothes treatment apparatus comprising:

a chamber forming a space for treating clothes;

a circulatory flow path configured to guide air for circulation through the chamber;

a drying fan disposed in the circulatory flow path to blow air for circulation;

a cooling water pipe disposed in the circulatory flow path and configured to flow cooling water into the circulatory flow path;

a water jacket disposed outside of the circulatory flow path and connected to an outlet of the cooling water pipe, into which, after exchanging heat with the air in the circulatory flow path, the cooling water is introduced;

a thermoelectric module configured to transfer heat from a heat absorbing surface to a heat generating surface; and a heat sink configured to take heat from the heat generating surface and heating the air that has exchanged heat with the cooling water pipe on the circulatory flow path, wherein the heat absorbing surface is configured to exchange heat with the water jacket.

2. The clothes treatment apparatus of claim 1, wherein the circulatory flow path comprises a condensing duct into which the air released from the chamber is introduced, wherein the cooling water pipe is disposed in the condensing duct, and the heat sink comprises:

a base having a first surface in contact with the heat generating surface, and a second surface disposed outside of the condensing duct; and at least one heat radiating fin that protrudes from the second surface of the base and is inserted into the condensing duct.

3. The clothes treatment apparatus of claim 2, wherein a recess is formed on an outside surface of the condensing duct, and the base is placed within the recess.

4. The clothes treatment apparatus of claim 1, further comprising a cooling water drain pipe configured to drain the cooling water in the water jacket to the circulatory flow path.

5. The clothes treatment apparatus of claim 1, wherein the circulatory flow path comprises:

a condensing duct having the cooling water pipe placed on an inside, into which the air released from the chamber is introduced; and a drying duct configured to supply the air passed through the condensing duct to the chamber, wherein a drying heater is provided within the drying duct.

6. The clothes treatment apparatus of claim 5, wherein the condensing duct has an inlet connected to the chamber and an outlet connected to the drying duct, wherein the inlet of the condensing duct is located lower than the outlet of the condensing duct.

7. The clothes treatment apparatus of claim 1, wherein the cooling water pipe comprises:

a downward guiding part having an inlet of the cooling water pipe and extending from the inlet of the cooling water pipe along a downward direction; and an upward guiding part having the outlet of the cooling water pipe and extending from a lower part of the downward guiding part to the outlet of the cooling water pipe.

8. The clothes treatment apparatus of claim 7, wherein at least one of the downward guiding part or the upward guiding part is bent multiple times such that the cooling water is repeatedly guided in a first horizontal direction and then in a second horizontal direction opposite to the first horizontal direction.

9. The clothes treatment apparatus of claim 1, wherein the cooling water pipe has an inlet through which the cooling water enters, and the inlet of the cooling water pipe is located lower than the outlet through which the cooling water is drained.

10. The clothes treatment apparatus of claim 4, wherein the circulatory flow path comprises a condensing duct, into which the air released from the chamber is introduced, wherein the cooling water pipe is disposed in the condensing duct, and wherein the cooling water drain pipe drains the cooling water towards the inner wall of the condensing duct.

11. The clothes treatment apparatus of claim 10, wherein the condensing duct has an opening for installing the cooling water pipe, and the apparatus further comprises a cover for opening and closing the opening.

12. The clothes treatment apparatus of claim 11, wherein the water jacket has an inlet through which the cooling water enters and an outlet through which the cooling water is drained, and wherein the inlet of the water jacket is located lower than the outlet of the water jacket.

13. The clothes treatment apparatus of claim 12, wherein the water jacket has a flow path from the inlet of the water jacket to the outlet of the water jacket that is bent in such a way that a flow direction of cooling water is reversed at least once.

14. A clothes treatment apparatus comprising:

a chamber forming a space for treating clothes;

a circulatory flow path configured to guide air for circulation through the chamber;

a drying fan disposed in the circulatory flow path to blow air for circulation;

a cooling water pipe disposed in the circulatory flow path and configured to flow cooling water inside the circulatory flow path;

a water jacket disposed outside of the circulatory flow path and connected to an outlet of the cooling water pipe, into which, after exchanging heat with the air in the circulatory flow path, the cooling water is introduced; and a thermoelectric pump mechanism configured to absorb heat from the cooling water in the water jacket and configured to transfer the heat to the air in the circulatory flow path that passed through the cooling water pipe.

15. The clothes treatment apparatus of claim 14, wherein the thermoelectric pump mechanism comprises:

a thermoelectric module configured to transfer heat from a heat absorbing surface to a heat generating surface; and a heat sink configured to take heat from the heat generating surface and heating the air that has exchanged heat with the cooling water pipe on the circulatory flow path, wherein the circulatory flow path comprises a condensing duct into which the air released from the chamber is introduced, wherein the cooling water pipe is disposed in the condensing duct, and the heat sink comprises:

a base having a first surface in contact with the heat generating surface, and a second surface disposed outside of the condensing duct; and at least one heat radiating fin that protrudes from the second surface of the base and is inserted into the condensing duct.

16. The clothes treatment apparatus of claim 15, wherein a recess is formed on an outside surface of the condensing duct, and the base is placed within the recess.

17. The clothes treatment apparatus of claim 14, further comprising a cooling water drain pipe configured to drain the cooling water in the water jacket to the circulatory flow path.

18. The clothes treatment apparatus of claim 14, wherein the circulatory flow path comprises:

a condensing duct having the cooling water pipe placed on an inside, into which the air released from the chamber is introduced; and a drying duct configured to supply the air passed through the condensing duct to the chamber, wherein a drying heater is provided within the drying duct.

19. The clothes treatment apparatus of claim 14, wherein the cooling water pipe comprises:

a downward guiding part having an inlet of the cooling water pipe and extending from the inlet of the cooling water pipe along a downward direction; and an upward guiding part having the outlet of the cooling water pipe and extending from a lower part of the downward guiding part to the outlet of the cooling water pipe.

20. The clothes treatment apparatus of claim 19, wherein at least one of the downward guiding part or the upward guiding part is bent multiple times such that the cooling water is repeatedly guided in a first horizontal direction and then in a second horizontal direction opposite to the first horizontal direction.

* * * * *